United States Patent [19]

Bonk

[11] 3,986,479

[45] Oct. 19, 1976

[54] PRE-MOISTENED TOWELETTE DISPENSER

[75] Inventor: Joseph P. Bonk, Des Plaines, Ill.

[73] Assignee: Colgate-Palmolive Company, New York, N.Y.

[22] Filed: Oct. 11, 1973

[21] Appl. No.: 405,503

[52] U.S. Cl. ..... 118/506; 118/43; 206/410; 221/47; 225/52; 225/106

[51] Int. Cl.[2] ..... B05C 11/00

[58] Field of Search ..... 225/106, 42, 52; 206/389, 409, 410; 220/31 S, 29; 222/180; 242/55.53; 221/63, 283, 47; 118/43, 506

[56] References Cited

UNITED STATES PATENTS

| | | | |
|---|---|---|---|
| 1,476,063 | 12/1923 | Englerth | 221/284 X |
| 2,235,675 | 3/1941 | Fournier | 221/63 |
| 2,633,984 | 4/1953 | Jurzyniec | 225/32 |
| 2,646,877 | 7/1953 | Scholl | 206/409 |
| 2,673,008 | 3/1954 | Ryan | 222/180 X |
| 2,737,149 | 3/1956 | Collins, Jr. et al. | 118/43 |
| 2,806,591 | 9/1957 | Appleton | 225/106 |
| 2,840,266 | 6/1958 | Nelson | 221/48 |
| 3,383,012 | 5/1968 | Adell | 221/46 |
| 3,490,645 | 1/1970 | Glass et al. | 221/63 X |
| 3,523,653 | 8/1970 | Hansen | 242/106 |
| 3,749,296 | 7/1973 | Harrison | 225/106 |
| 3,780,908 | 12/1973 | Fitzpatrick et al. | 221/63 X |
| 3,784,055 | 1/1974 | Anderson | 221/63 |
| 3,795,355 | 3/1974 | Gerstein | 225/32 X |
| 3,868,052 | 2/1975 | Rockefeller | 225/106 |

FOREIGN PATENTS OR APPLICATIONS

| | | | |
|---|---|---|---|
| 303,304 | 11/1972 | Austria | 118/400 |
| 527,601 | 9/1972 | Switzerland | 225/106 |
| 7,721 | 6/1899 | United Kingdom | 128/169 |
| 667,183 | 2/1952 | United Kingdom | 206/389 |

*Primary Examiner*—Mervin Stein
*Attorney, Agent, or Firm*—Jacques M. Dulin; Powell L. Sprunger

[57] ABSTRACT

Towelette dispenser and vapor impervious pouch containing a roll or web of absorbent material, such as nonwoven fibrous towelettes pre-moistened with a chemical-containing aqueous or other fluid solution. The pouch is sealed before use to prevent the loss of moisture from the pre-moistened towelette roll and is opened at the point of, and at the time of, first use. A double lid is adapted to provide moisture seal between usages of the pre-moistened towelette, while reducing dehydration of the opened towelette pouch within the dispenser. Feed slit adaptations in the lid provide for selective tearability of individual towelette portions from the roll. The dispenser is adapted to provide a low center of gravity, and the base of the dispenser can cooperatingly engage a wall-type holder. The towelette roll contains a leader adapted for ease of feeding through the feed slot upon first use. The web may be folded parallel to the longitudinal axis to provide larger towelettes and improve ease of withdrawal from the dispenser.

33 Claims, 16 Drawing Figures

13
47
46
20
45
2
11
62
63
115
14
12
43
8
42
116
277
4
7
31
6
5
61
34
177
51
351
1
60
39
40
57
59
10
15
49
50
58
57
35
16
37
38
48
52
53
3
55
54
56
7
8
4
5
1
15
16
35
45
46
20
47
2
13
11
42
12
44
43
6
31
17
4
1
15
35
16

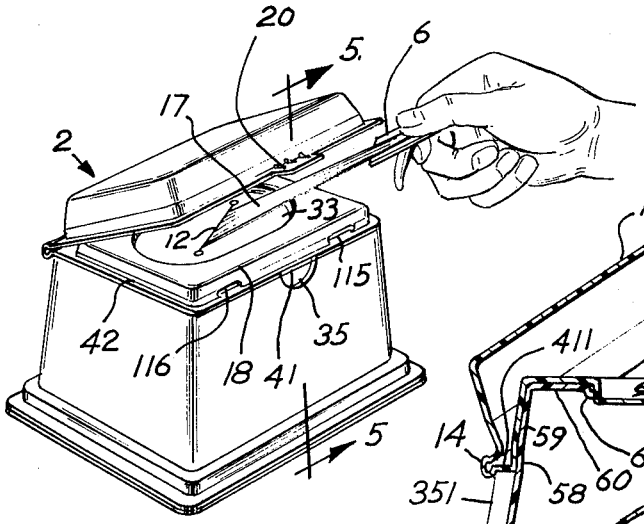
Fig. 4
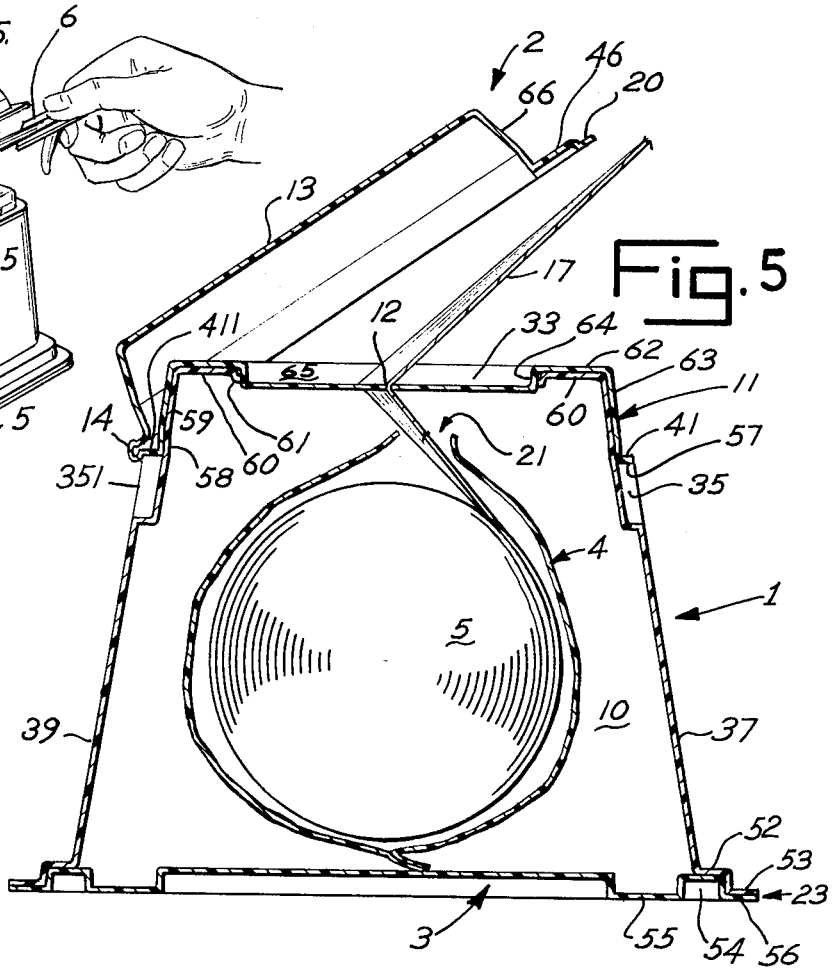
Fig. 5
Fig. 6
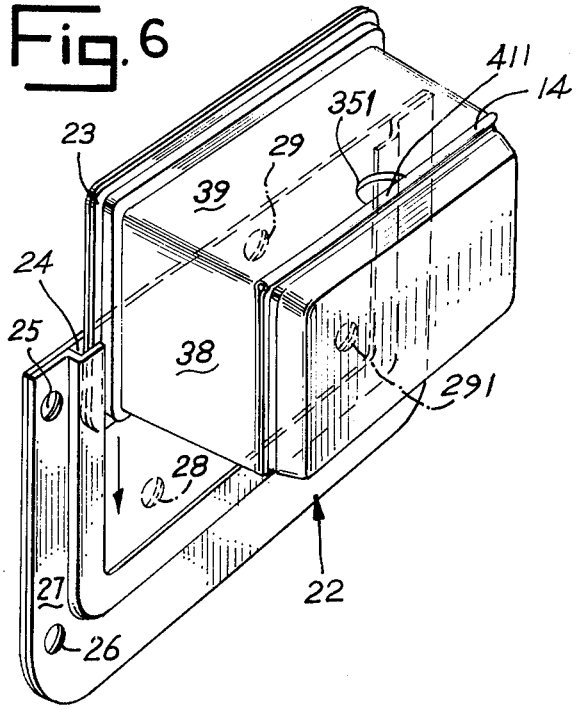
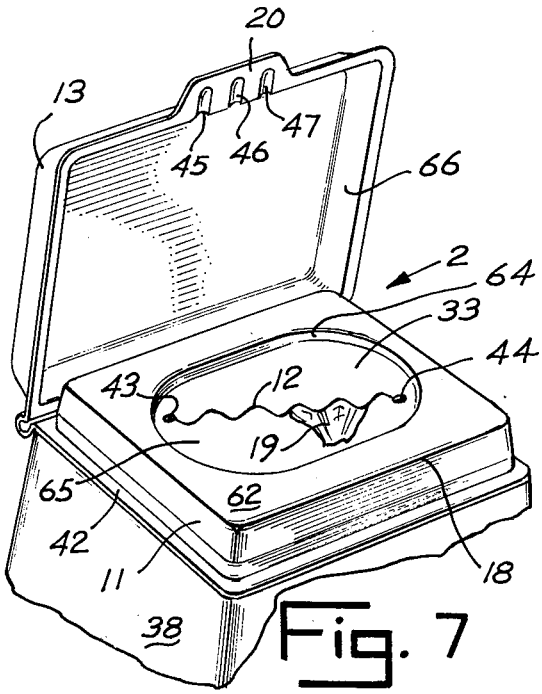
Fig. 7

Fig. 8
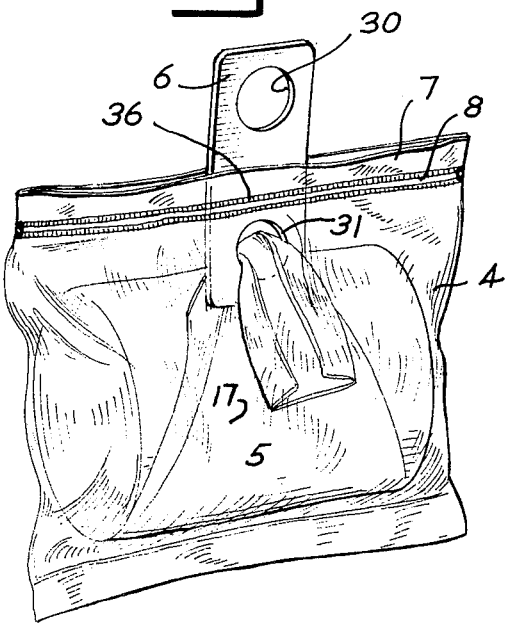
Fig. 10
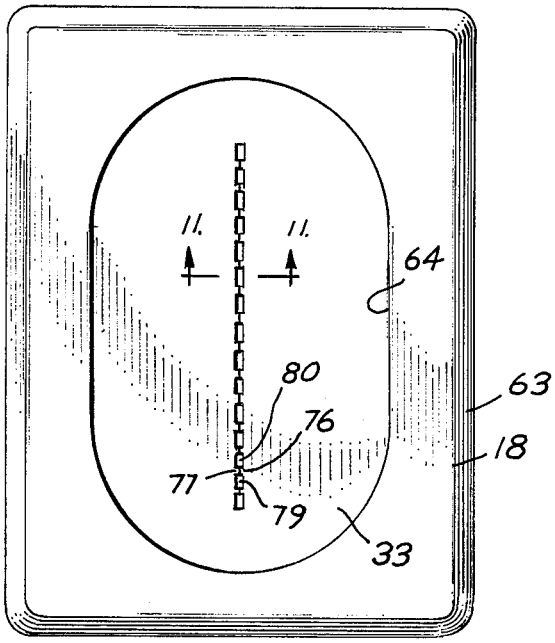
Fig. 11
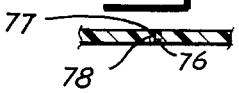
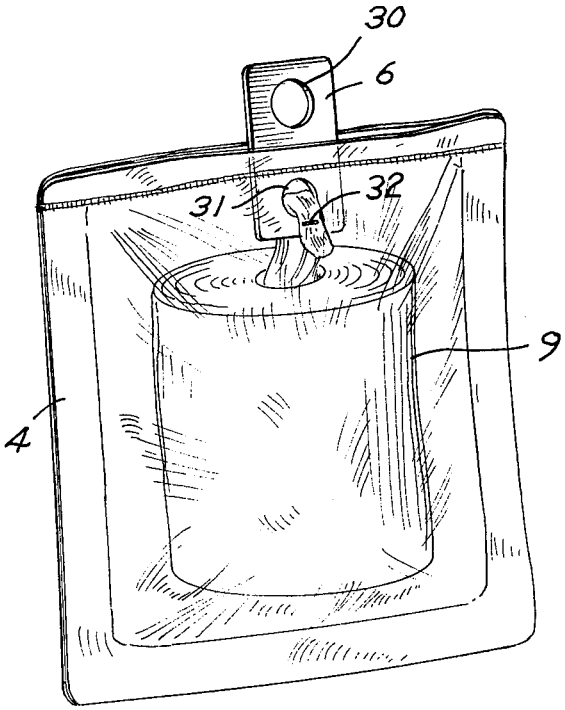
Fig. 9
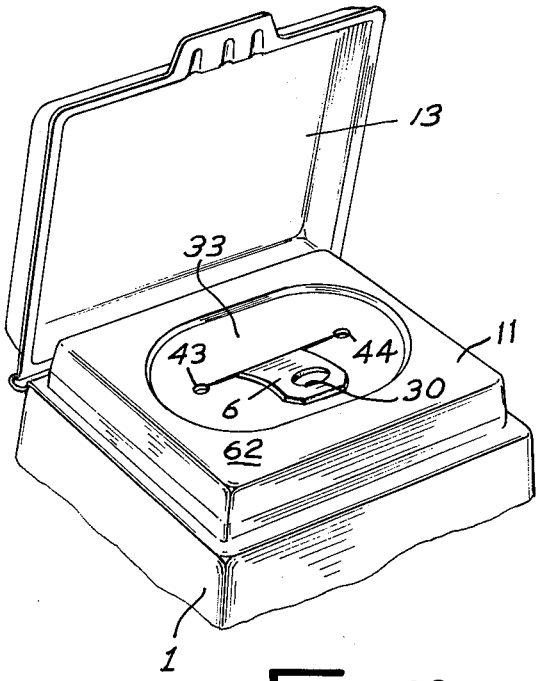
Fig. 12

PRE-MOISTENED TOWELETTE DISPENSER

FIELD OF THE INVENTION

This invention relates to a dispenser for a roll or web of pre-moistened absorbent material, such as non-woven fibrous towelettes. The application also discloses a special pouch and leader assembly containing the pre-moistened towelette roll for replacement use in the dispenser. The towelettes are pre-impregnated with a chemical-containing aqueous or other fluid solution to provide the towel with a pre-measured portion of washing fluid, lubricant or medicament at the point and time of use. Excessive dehydration of the towelette is prevented between uses of the individual towelette portions from the towelette roll.

BACKGROUND

Dry, disposable paper tissues are in widespread use for a variety of cleaning operations. More recently, pre-moistened tissues have been proposed or introduced. Typically, pre-moistened sheets are individually folded and wrapped in plastic or in metal-foil type packets. Because of the lack of wet strength of paper tissues, these pre-moistened, individually packaged tissue packets are generally heavy and not dispensed from a continuous roll. This is wasteful and not in keeping with sound ecological practices, since single sheet packaging requires a large amount of non-biodegradable plastic and/or metal-foil wrapping materials.

More recently, there have been attempts to introduce into the marketplace pre-moistened tissues that are interleaved like dry tissues. These are packaged in a container having a foil sealing member to prevent moisture loss while the container is on the shelf. In use, the foil is removed and the tissues are removed one at a time as use dictates. Interleaving is designed to permit ease of removal of the second tissue after the first is used. In one embodiment there is no replacement lid for the foil seal, and thus the package when once opened, tends to dry out rapidly. Other proposals have called for providing a tissue box type of plastic dispenser having a single lid with a conventional slot. However, this is only slightly improved over the removable foil lid type of assembly since the second tissue, being exposed through the slot, will dry. The continuous wicking action of the tissue fibers causes the moisture in the towelettes within the box to migrate to the dry tip of the exposed towelette. The entire contents of the tissue box dry out relatively rapidly. Further, the tissue box lids are not tight-fitting, and additional moisture loss may occur at the juncture between the lid and the box walls.

One attempt to overcome the problems of the continuous drying out through wicking or moisture vapor loss through lack of proper-fitting container lids has been to provide an excess of fluid along with the towelettes. This is shown, for example, in U.S. Pat. Nos. 3,310,353, 3,368,522 and 3,592,161. Each of these patents discloses a dispenser having a roll of towelette, either free rolling or mounted on a central spindle, partially immersed in excess fluid, or fluid contained in association with the dispenser for wetting the towel just prior to final dispensing. The latter approach is similar to the paper tape type of dispenser in which the paper tape passes over a wetted roller to moisten the glue just prior to use.

A variation of this approach is to provide a coreless tissue roll disposed upright in a cylindrical container containing excess fluid. The towel is withdrawn from the center of the core and passed through a special inverted conical or slanted top opening that provides a special sealing and cutting action.

Both of these fluid proposals have the disadvantage of requiring substantial amounts of fluid to be placed into the container upon manufacture and shipped with the container. In the three aforementioned patents, and the vertically oriented coreless towel dispenser, there does not appear to be positive means for preventing leakage of the excess fluid during transportation, such as would occur upon stacking of the cartons upside down. Further, the excess fluid could result in leaching of chemicals, such as soaps or medicaments, where those materials are not in equilibrium concentration in the liquid. Also, excess fluid may tend to reduce the wet strength of the towelette, requiring even heavier material which in turn may not be flushable after use, and therefore causing problems with plumbing fixtures. They are also less adaptable to medicinal uses where a soft towelette with good hand is required in order not to cause irritation to the skin area treated.

There is thus a need for a roll-type moist towelette dispenser containing a plurality of individual towelette sheets which are individually separable from a continuous roll in a use-convenient type dispenser which has long shelf life and provides for intermediate sealing after each towelette is used, and which can accept replacement towelette rolls independent from the dispenser itself.

THE INVENTION

Objects

It is therefore an object of this invention to provide an improved moist towelette dispenser of the roll type which may be reused, yet which is sufficiently inexpensive to be disposable after single use.

It is another object of this invention to provide a moist towelette dispenser that provides improved shelf life for the towelettes without requiring supply and shipment of excess liquid.

It is another object of this invention to provide an improved pre-moistened towelette dispenser that is pre-threaded for use and disposable.

It is another object of this invention to provide a moist towelette dispenser which is substantially leak-proof.

It is another object of this invention to provide an improved moist towelette dispenser which has improved properties of preventing substantial dehydration between use of individual sheets from the roll.

It is another object of this invention to provide replacement moist towelette pouches containing a roll of pre-moistened absorbent material for use in conjunction with a towelette dispenser.

It is another object of this invention to provide a moist towelette pouch assembly which is easy to handle and thread into the dispenser, yet has long shelf life prior to use.

It is another object of this invention to provide a pre-moistened roll of absorbent material which is adapted for adequate pull strength through a slot, yet which can be easily separated into individual towelettes at perforations provided in the web.

It is another object of this invention to provide an improved moist towelette dispenser which has a low center of gravity, making it easy to remove the towelettes therefrom without tipping over, and which may be adapted to use in a wall bracket.

It is another object of this invention to provide an improved moist towelette dispenser and pouch assembly which has the above advantages, and from which it is easy to withdraw the absorbent web material without breakage or tearing of the web at the perforations when not desired, and not requiring rethreading for each towelette.

These and other objects of the invention will become evident from the detailed description which follows.

FIGURES

The description of the invention is made with reference to the drawings in which like parts are given like numbers in the various figures.

FIG. 4 shows in perspective the manner of withdrawing individual towelettes from another form of the dispenser in its assembled condition;

FIG. 5 is a section view through lines 5—5 of FIG. 4;

FIG. 6 shows in perspective one embodiment of the dispenser assembly adapted to be inserted in a wall bracket;

FIG. 7 shows in perspective an alternative embodiment of the double seal cap or top lid of the dispenser assembly;

FIG. 8 shows in perspective an alternative embodiment of the towelette roll pouch and leader assembly;

FIG. 9 shows in perspective an alternative embodiment of the pouch employing a coreless center feed roll of tissues;

FIG. 10 shows a plan view of another embodiment of the inner top with a serrated feed slit;

FIG. 11 is a cross-section of the feed slit of FIG. 10 taken along lines 11—11 of FIG. 10;

FIG. 12 shows in perspective another embodiment of the invention wherein the pouch with exposed leader such as shown in FIG. 8 is pre-fed through the feed slit in the inner top and ready for use as purchased by the consumer;

SUMMARY

A pre-moistened towelette dispenser is provided with an interior volume containing a pouch holding a web of a pre-moistened absorbent material in roll form. The single or plural thickness web is pre-perforated to define a continuous roll of individually separable towelettes. The web may be single layer, plural individual layers, or folded parallel to its longitudinal axis to provide larger towelettes; there may be plural folds. The pouch is characterized as being substantially moisture impervious in the sealed condition, and the towelette roll has a leader attached to the first towelette for ease in threading through the dispenser tear slit. The leader may extend beyond the margin of the pouch and may be prethreaded in the dispenser. The dispenser further has a special double cap for providing a tight seal with the container to prevent loss of moisture between usages of individual towelettes. A number of embodiments are disclosed.

DETAILED DESCRIPTION

The following detailed description of the presently preferred embodiments of the invention and the figures, are by way of illustration and not by way of limitation of the principles of the invention.

Figures 1, 2, 3:
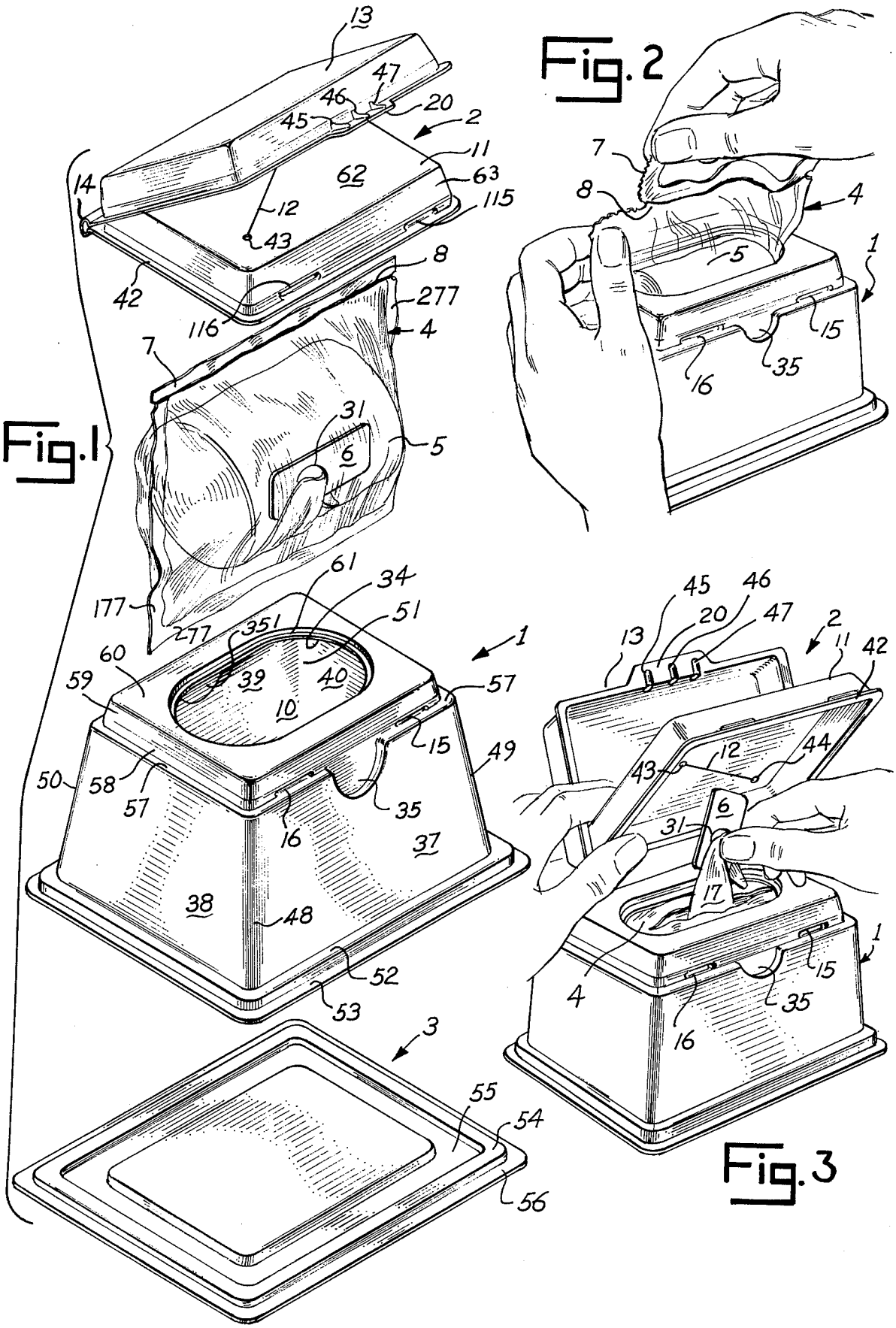
FIG. 1 shows in an exploded perspective view the parts of the towelette assembly and pouch sub-assembly.
FIG. 2 shows in perspective one manner of opening the pouch as it is disposed in the dispenser.
FIG. 3 shows in perspective the manner of threading the leader through the towelette dispenser top assembly.

Referring now to the drawings, FIG. 1 shows in an exploded perspective the basic components of the dispenser assembly. The dispenser assembly in this embodiment comprises body 1, top 2 and base 3. These may be of any suitable material, such as plastic, for example, a polyolefin such as polyethylene, or polypropylene, a polystyrene, an acrylate polymer, polyvinyl or polyvinylidene chloride, a polyester and the like. The preferred material is a thin polystyrene which is molded by conventional techniques, and is sufficiently inexpensive to be disposable after single use. The pouch 4 contains a pre-moistened towelette roll 5, one end of which is attached to a leader 6.

The pouch is substantially vapor impervious, and is sealed, e.g., by heat sealing, along those margins that require it, such as margin 7 as shown. Typically the pouch will be made of a heat sealable plastic and sealed along margins 7, 77, 177 and 277. Where the pouch is extruded as a tube, only two margins, such as 7 and 77, need be sealed. Means for providing an easy tear 8, such as weakened groove in the middle of the seal, a tear thread or plastic member or the like, is provided in the pouch margin for ease of opening. This is illustrated in FIG. 2, which shows the pouch being opened by a pull-type shearing action of margin 7 relative to the body of pouch 4.

The pre-moistened towelette is a continuous web or pre-moistened absorbent material, which in a preferred embodiment is formed into a coreless roll, best seen in section in FIG. 5. However, it is to be understood that the roll may have a hollow or solid core for convenience in manufacture or unwinding. In the embodiment shown herein, the web is preferably unrolled from the exterior as shown. However, the web may be unwound from the center of a coreless roll such as illustrated in FIG. 9.

The web or towelette roll may be impregnated at the point of manufacture with a variety of aqueous or nonaqueous solutions depending on the use desired. For example, the towelette may be impregnated with an aqueous soap or detergent solution which optionally may contain humectants, lanolin, perfumes, and the like. The web shown in FIGS. 4 and 5 is single thickness, but may be folded parallel to the longitudinal axis of the web to provide a plurality of thicknesses, double with a single fold, triple with a double fold, etc., as shown in FIGS. 13 - 16. A typical towelette material is a 22 gram/sq. yd. web 5¾ inches wide, longitudinally centerfolded to 2⅞ inches wide, of non-woven fibrous cellulosic or synthetic material as in FIGS. 13 and 14. This is a flushable weight material. The web conveniently may be perforated perpendicular to its longitudinal axis every 8 inches to provide individually removable towelette portions.

The moisture-impervious pouch may be a co-extruded or laminated plastic bag of ½ mil "Mylar" (a Du Pont polyester plastic) for the exterior layer, a ½ mil "Saran" (a Dow Chemical Co. polyvinylidene chloride polymer) for the middle layer, and a 1–2 mil low density polyethylene or polypropylene for the inner layer. The presently preferred pouch material is an extruded polyolefin, for example, a polyethylene sheet 2–3 mils in thickness, or a co-extruded sheet of "Saran" and polyethylene, polyethylene-polyethylene, or polyethylene "Surlyn" (a Du Pont ionomer plastic polymer).

These pouches are suitable for use with a variety of solutions and solvents, such as water, alcohol, or alcohol and water solutions, which may also contain a chemical such as a cleansing agent, an antiseptic or the like material for skin treatment or cleaning. The additional components of the solutions may be useful for hygienic use, first aid use such as for sunburn, heat rash, poison ivy or poison oak treatment, and the like.

The base 3 may be fitted or adhered, such as by heat sealing, to the body 1 to form the dispenser container having an interior volume 10 into which the pouch 4 fits. This is more clearly shown in FIGS. 2, 3, and 5.

Referring to FIGS. 1, 2, 4–7, and 12, the top 2 is a double top having an inner member 11 containing a feed slit 12 and an outer top member 13. The two portions of the top are hinged as at 14. In the embodiment shown, the hinge 14 is a C-shaped in cross-section, continuous plastic hinge which is a portion of both the inner and outer top members 11 and 13, respectively. This prevents loss of the top member 13 and provides a continuous vapor seal at the hinge.

As initially provided to the consumer, the towelette dispenser is provided assembled with the pouch 4 contained in the interior 10 of the body 1, and the top press-fit thereon. Cooperative snap-fit means are provided in the body and top. The means comprises positive lock indentations 15 and 16 provided in the body 1 (FIGS. 1–3) which are adapted to receive corresponding lugs 115 and 116 molded into the inner top member 11 of the top 2. The snap-fit means may be provided on a plurality of the side walls of the body and inner top walls as desired. This provides for a keyed fit of the top onto the top-receiving portion of the body. As shown in FIGS. 7 and 12, the snap-fit means may be omitted and the inner top 11 dimensioned to provide a snug friction fit with the top of the inclined dispenser side walls 37, 38, 39, and 40. The inner top 11 may optionally be adhered to the body for the single-use, disposable dispenser of the FIG. 12 type.

Referring now to FIG. 2, one manner of placing the dispenser in use comprises removal of the dispenser top by grasping the closed double top and unkeying the snap-lock means. To assist opening, finger recesses 35 and 351 are provided in the inclined side walls 37 and 39 as shown in FIGS. 1–6. These recesses expose portions 41, 411 of inner top outer marginal rim 42, as seen in FIGS. 4–6. Upward pressure on the rim portions 41, 411 relative to the body unlocks the snap means 15, 16 from the cooperating recesses 115, 116, releasing the top. The consumer then reaches into the body and grasps one corner of the pouch as shown. The pouch is opened by pulling (shearing) the upper sealed margin 7 along tear line 8 as shown, or by pulling a tear thread or member embedded in the seal. The consumer then reaches into the pouch 4 and grasps the leader 6. This leader, attached to the first towelette on the roll 17, as by a simple knot (FIG. 1) or by stapling (FIG. 8), is then threaded through the feed slit 12 in the inner top member. This operation is shown in FIG. 3.

As shown in FIG. 4, the top is then replaced on the body 1, and the leader pulled to unroll the first towelette 17 of the web through the slit. The slit 12 in FIGS. 1, 3, 4, 5, and 7 is shown disposed generally diagonally with respect to the facing edge 18 of the juncture of the inner top member 11 and inclined side wall 37. This facilitates tearing of the desired number of towelette portions from the roll. The towelette roll preferably comprises a non-woven web of pre-moistened, flushable natural or synthetic fibrous material which is perforated at predetermined intervals along the roll to provide individual towelette portions. The perforations may be at right angles to the length (longitudinal axis) of the web, or may be disposed at an angle (diagonally) with respect thereto. Where the web is pre-perforated in a diagonal manner, it is preferred that the pouch with roll be placed in the dispenser so that the perforation diagonal is oriented substantially parallel to the slit 12 in the inner top 11 as the web is withdrawn from the dispenser. This provides a graspable, leading tip 19 (see FIG. 7) of the next towelette which is left behind after the web is torn at the perforation to separate an individual towelette from the roll.

The tear slit may be in several embodiments as seen by comparing FIGS. 1, 7, 10, 11, and 12. In FIGS. 1 and 12 the slit is a substantially straight die cut slot with a small circular cut-out at each end 43, 44 to prevent accidental splitting of the plastic body. Since the slit is disposed at a diagonal, once the tear is commenced from either the lower front corner or the upper rear corner, a graspable tip of the second towelette 19, as best shown in FIG. 7, remains behind. After the desired number of towelettes have been dispensed from the roll and torn off, the outer top member 13 is then pressed down onto the inner top member 11. As best shown in FIG. 7, the remaining graspable tip 19 of the second towelette is sealed between the two lids and dehydration of the tip, that towelette portion in the space 10, and the rest of the roll in the pouch is retarded.

When the next towelette is desired to be removed, the outer top member 13 may be lifted from the inner by means of flange 20, optionally having one or more reinforcing ribs 45, 46, 47 therein, as seen in FIGS. 1, 3, 5, and 7. The exposed tip 19 is then pulled to dispense additional towelettes as desired.

As seen in FIG. 5, the fluid impervious pouch 4 remains in place around the towelette roll 5 throughout its entire life and provides only a small aperture 21 for vapor loss. However, the vapor loss is generally confined to the interior volume 10 of the dispenser assembly. This prevents vapor, e.g., moisture, loss from the interior of the roll, and negates the requirement for large volumes of additional liquid to maintain the absorbed fluid content of the web in the roll. The chemical-containing fluid is impregnated in the absorbent web material in an amount sufficient to be retained by the absorbent material under normal use conditions without substantial excess of free fluid in the pouch. There may be a few condensation droplets formed in the pouch under certain conditions, but these can be readsorbed or absorbed by the web material. The web and roll are thus saturated, i.e., sorbed substantially to its capacity, but not flooded, i.e., partially immersed in excess fluid.

Referring to FIGS. 1 and 5 for details of the body construction, the body comprises two pair of generally planar side walls, pair 37, 39 being longer than pair 38, 40. The common edges 48, 49, 50, 51 may be rounded. The broader, base receiving, lower portion of the generally inclined side walls may have one or more shoulders 52, 53. Shoulder 52 cooperates with a corresponding marginal recess 54 in bottom 3 to receive and retain the bottom. Rib 55 in the bottom, along with marginal flange 56 defines the recess 54. Rib 55 provides strength to the generally planar bottom 3 and a contact surface. Marginal flange 56 cooperates with shoulder 53 to provide additional mating surface with body 1, and is adapted for cooperatingly engaging means for removably holding the dispenser on a surface, as is described in more detail with respect to FIG. 6, below. The bottom 3 may be dimensioned to frictionally engage body 1, or may be adhered, as by heat sealing along a portion of flange 23, or snap-fit theretogether.

The upper margin of body 1 is adapted to receive the top 2. Upper shoulder 57 receives the rim flange 41 of the inner top member 11. The body extends upwardly i a first vertical wall portion 58 and then inwardly in tapered wall portion 59. These are terminated by inwardly extending flange 60 which optionally has a depending reinforcing lip 61. The inwardly extending flange 60 defines a body top portion plane generally parallel to the bottom 3, and provides aperture 34 through which the pouch is accessible.

The inner top 11 has a generally planar outer margin surface 62, exterior depending walls 63 generally conforming to the shape of upper vertical and tapered wall portions 58, 59 of the body, and terminating in outer marginal rim or flange 42. Slit 12 is disposed in the planar surface 62, which may be flat as shown in FIGS. 1 and 3 or, preferably, is contained within inner recessed portion 33 as shown in FIGS. 4, 5, 7, 10, and 12. The recess is connected to the outer margin surface 62 by depending wall 64. The inner recess portion 33 is generally parallel to the outer margin surface 62 and defines cooperatively with outer top 12 a space 65 to contain the leader 6, as in FIG. 12, or the next towelette tip 19. Outer top member 13 has depending outer walls 66 generally corresponding and mating to walls 63 of inner top member 11 to provide a snug, low vapor-loss fit when closed. The depending inner wall 64 may be spaced from outer wall 63 to cooperatively provide a snap-type fit with lip 61. Depending inner wall 64 and recess 33 also function to provide rigidity to the inner top member 11, and reduce the tendency of slit 12 from tearing. The pouch thus cooperates with the dispenser body and the double seal cap in the manner shown to prevent moisture loss and thereby provide long shelf life prior to use and long life in use after opening.

FIG. 6 also illustrates placement of the dispenser into holder 22. The base of the dispenser has a peripheral flange 23 formed in this embodiment from base shoulder 53 and bottom marginal flange 56, which is adapted to be received by slot 24 in the holder 22. The slot 24 may extend around a plurality of the sides of the dispenser to receive the flange 23. The holder may be conveniently fastened to a receiving surface, such as a table, countertop, or wall by various types of fastening means. As shown, screws 25, 26 may be disposed in an exterior marginal edge portion 27 of the holder. In another alternative, the screws may be hidden as at 28, 29, 291 so as to be covered by the base of the dispenser when it is positioned in the holder 24.

The holder may also be adhered, e.g., as by tape or an adhesive, to a receiving surface. Optionally, the base 3 of the dispenser may be adhered or adapted to be fastened directly to a receiving surface. The trapezoidal, cross-sectional shape of the dispenser, as best illustrated in FIG. 5, provides a relatively low center of gravity so that the dispenser has a reduced tendency to tip over in use. This tends to permit use of the dispenser in a one-handed fashion.

Turning now to FIG. 7, this figure illustrates an alternative embodiment of the top wherein the feed slit 12 is generally sinusoidal in configuration rather than being a straight slit as shown in FIGS. 1, 3, and 4. While shown disposed at a diagonal to the facing edge 18 of the inner top member 11, it should be understood that the feed slit can be disposed in a generally parallel orientation as in FIGS. 10 and 12. Likewise, the diagonal need not be from upper right to lower left as in FIGS. 1 and 4, but may also be disposed from upper left to lower right as seen from the orientation of FIG. 7.

FIG. 8 shows an alternative embodiment of the pouch 4. In this embodiment, the towelette roll 5 is unwound from the exterior as before, and also contains a leader. However, in this preferred embodiment, the leader is at least partially exposed beyond the outer marginal edge 7 of pouch 4. The pouch is heat sealed to the leader to prevent vapor or moisture loss where it comes into contact with the projecting portion 36 of leader 6. To open, the consumer merely threads the leader through the slot in top 11, and pulls the leader 6 to simultaneously release edge seal 36 and unroll the towelettes as desired. Optionally provided is a hole 30 in the exposed portion of the leader for insertion of the finger to assist in pulling. The first towelette 17 may be attached as before through a hole 31 in the interior of the leader. It should be understood that the hole 31 is optional, and the first towelette may be fastened by other means to the leader 6, such as by stapling (FIG. 8), threading through a slot, or the like. As shown in FIG. 12, a portion of the leader 6 may be pre-threaded through the slit where the dispenser is initially provided with the pouch and roll therein.

FIG. 9 illustrates still another embodiment of the pouch having an exposed leader 6. In this embodiment, the towelette is withdrawn from the interior of a coreless roll 9 rather than from the exterior as shown in FIG. 8. This embodiment also illustrates an alternative manner of attaching the first towelette to the leader 6. In this embodiment, the first tissue is stapled as at 32 to the interior portion of the leader 6. To provide secure stapling, the first tissue advantageously may be folded to provide a double thickness where the staple passes through the leader.

The leader may be of any convenient material, such as a high density polyolefin, such as polyethylene or polypropylene, for example an 8 mil thick polyethylene leader. The leader and/or the pouch itself may be color coded or imprinted with indicia to identify the type of pre-moistened fluid contained there within. For example, a soap or detergent impregnated towelette may have a blue leader or bag, while a medicinal may have a clear bag with a white leader, etc.

The pouch is conveniently assembled by placing a dry roll of absorbent web in the pouch, adding a pre-measured portion of liquid therein, sealing the open side of the pouch (with or without leader exposed), and permitting the liquid to wick into the roll so all the liquid is absorbed. The pre-moistened roll may also be sealed into the pouch directly. The replacement pouches may be inserted into the dispenser through top body aperture 34 or by removing replaceable bottom 3. In the latter case, the top aperture 34 may be reduced in size to form a feed slot, and the top 2 may omit inner top member 11 with the top 13 optionally hinged to body wall 39. In this embodiment the leader 6 is elongated to permit ease of feeding through the feed slot.

FIGS. 10 and 11 show a slit parallel to front edge 18 of serrated design. Teeth 76 and 77 are opposed and substantially vertically straight-edged along abutting tooth surface 78 as seen in section in FIG. 11. The teeth are periodically relieved at 79, 80, etc., to provide a slight gap or separation, typically of width approximately that of a single web thickness or less. The serrated tooth slit may also be diagonally oriented with respect to edge 18.

Figure 13:
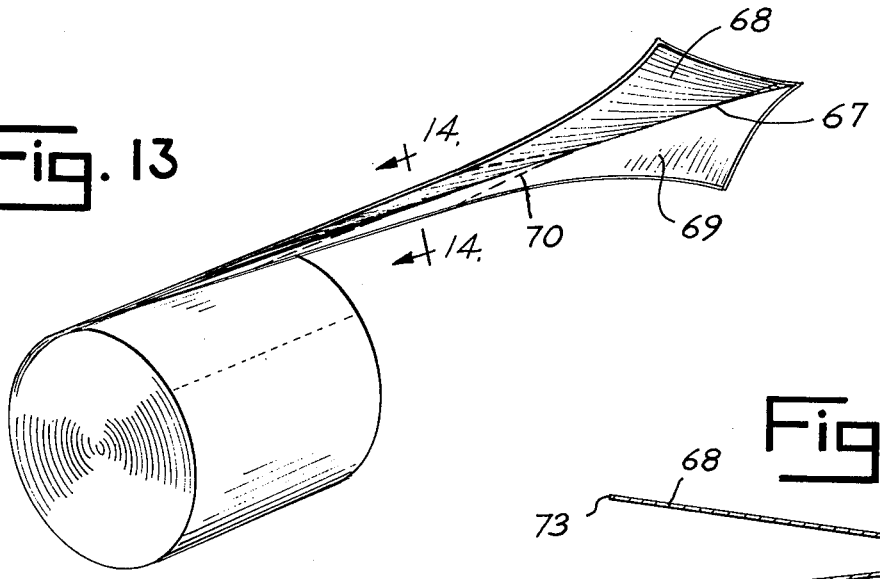
FIG. 13 shows in perspective another arrangement for winding the web in a single, offset fold into a roll.
Figure 14:
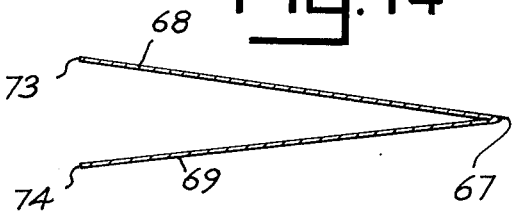
FIG. 14 is a cross-section taken along lines 14—14 FIG. 13 of the absorbent web of FIG. 13 in a partly unfolded condition.
Figure 15:
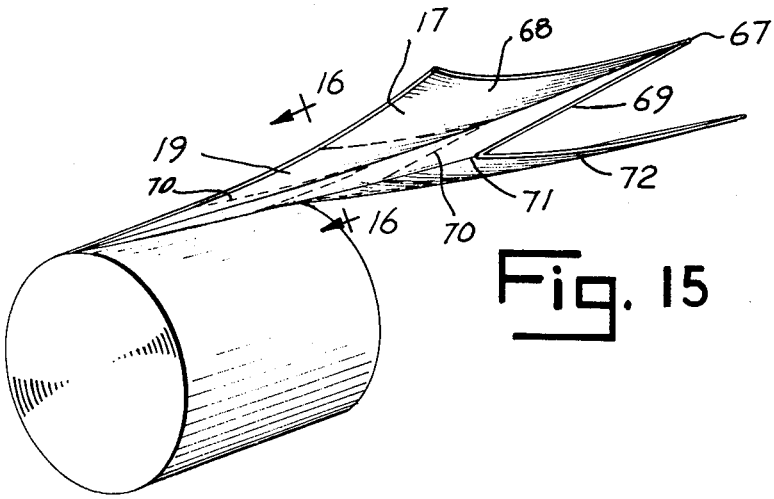
FIG. 15 shows in perspective another arangement for winding the web in a double or Z-fold into a roll for providing larger towelettes.
Figure 16:
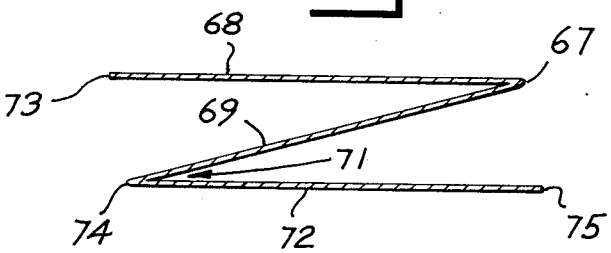
FIG. 16 is a cross-section taken along lines 16—16 of FIG. 15 showing the web of FIG. 15 in a partly unfolded condition.

FIGS. 13–6 illustrate other embodiments of the web which incorporates one or more folds parallel to the longitudinal axis of the web. FIGS. 13 and 14 illustrate a single fold line 67 along a line parallel to the longitudinal axis of the web, defining a first leaf 68 and second leaf 69. The fold may be a center fold to define leaves of equal width, or may be offset as in FIG. 14 so that one leaf 69 is smaller than the other, i.e., edges 73 and 74 are parallel but not aligned, to assist in separating the moist leaves. Perforations 70 are spaced to provide, typically, a length of 8 inches of web. Thus with the fold, a 5¾ inches × 8 inches towelette can be placed in a dispenser smaller than 5¾ inches wide since the folded web width is approximately 2⅞ inches to 3½ inches wide. Similarly, FIGS. 15 and 16 show a double longitudinal or Z-fold, with folds 67 and 71 forming 3 leaves, 68, 69, and 72. In this embodiment leaves 68 and 69 are of equal width, i.e., edges 73 and 74 are aligned, while edge 75 overlaps fold 67 to provide a larger leaf 72. Leaves 68 and/or 72 may be smaller or equal in size to leaf 69.

The longitudinal fold also provides reinforcing of the web for ease of withdrawal from the pouch 4 and slit 12 without inopportune tearing and loss of the next towelette 19 inside the dispenser necessitating rethreading. Folding also permits use of thinner web material and accordingly, more towelettes of better "hand" per roll without loss of pull strength or false tearing. The tearing-off is accomplished by a downward and crosswise movement, initiating the tear at the intersection of the perforation and slit, and continuing the tear along perforations which are exterior of the slit by virtue of its diagonal orientation.

In addition, it should be understood that the dispenser may have a plurality of interior volumes or cavities and corresponding feed slits in the top so that a number of differing types of pouches and rolls may be used. This is a single dispenser having different types of towelettes for bathroom, laboratory or hospital use. Likewise, the towelette web itself may be color coded or imprinted to identify the type of pre-treatment applied thereto. Thus, in a single dispenser, the top portion of the body may have a plurality of feed slits rather than a single slit for receiving a plurality of pouches. This would provide in a single dispenser, for example, a detergent type of pre-moistened towelette, alcohol-containing type, and a medicinal type.

It should be understood that various modifications within the scope of this invention can be made by one of ordinary skill in the art without departing from the spirit thereof. I therefore wish my invention to be defined by the scope of the appended claims as broadly as the prior art will permit, and in view of this specification if need be.

I claim:

1. A pre-moistened towelette dispenser assembly comprising:

a. a body having inclined side walls defining:
   1. a base-receiving portion broader than a top-receiving portion, and
   2. a cavity for receiving a towelette roll assembly;

b. a pre-moistened towelette roll assembly disposed in said cavity comprising:
   1. a substantially vapor impervious sealed pouch,
   2. a roll of a web of absorbent material, disposed in said pouch, said web having lines of perforations disposed spaced apart longitudinally along said web to define individual towelettes when severed from said web,
   3. a leader attached to said web for withdrawing web from said roll and for threading said web through a slit in the top portion of said dispenser,
   4. a chemical-containing fluid impregnated in said absorbent material, and
   5. said fluid is an amount sufficient to be retained by said absorbent material to maintain said web in a pre-moistened condition under normal use conditions, without substantial excess of free fluid in said pouch;

c. a base portion cooperatingly engagable to said body;

d. a removable and replaceable top portion including a feed slit, said slit being disposed at an angle relative to the juncture of at least one side wall and said top portion.

2. A pre-moistened towelette dispenser assembly as in claim 1 wherein said base portion is sealed to said body.

3. A pre-moistened towelette dispenser assembly as in claim 2 wherein said top portion includes a generally planar surface in which said feed slit is disposed and said juncture is defined by a line of intersection of planes in which said side wall and said top portion lie.

4. A pre-moistened towelette dispenser assembly as in claim 1 wherein:

a. said top portion includes:
   1. an inner top member, and
   2. an outer top member;

b. said outer top member is hingedly attached to said inner top member along an edge common to said top members;

c. said inner top member and outer top member, said inner top member and said body, and said base portion and said body, are adapted to provide a tight fit therebetween resulting in low vapor loss therethrough;

d. said inner top member includes an outer margin and an inner recessed portion oriented spaced apart and parallel to each other and generally parallel to said base;

e. said slit is disposed in said inner recessed portion;

f. said inner recessed portion and said outer top member defining a space for retaining a portion of a towelette or its leader in a manner to reduce vapor loss from said towelette; and g. a portion of said leader extends exteriorly of a margin of said pouch, with a portion of said pouch margin being vapor sealed around said leader.

5. A pre-moistened towelette dispenser assembly as in claim 4 wherein a portion of said leader projects through said feed slit into said retaining space between said inner recessed portion and said outer top member.

6. A dispenser as in claim 4 wherein said inner top member includes means for providing a snap-fit with said body.

7. A pre-moistened towelette assembly as in claim 4 wherein said exterior portion of said leader is adpated to be grasped to assist in breaking said seal and withdrawing web from said roll.

8. A pre-moistened towelette dispenser assembly as in claim 1 wherein the breadth of said base portion in relation to the height of said body is adapted to reduce the tendency of tipping over of said dispenser upon one-handed tearing of individual towelettes from said roll.

9. A pre-moistened towelette dispenser assembly as in claim 1 wherein the angle of said slit is oblique to said juncture.

10. A dispenser as in claim 1 wherein said top portion includes:

a. an inner top member, and b. an outer top member, said slit being disposed in said inner top member, said outer top member being hingedly attached to said inner top member along an edge common to said top members, said inner top member and outer top member, said inner top member member and said body, and said base portion and said body, all being adapted to provide a tight fit therebetween resulting in low vapor loss therethrough.

11. A dispenser as in claim 1 wherein said slit is serrated to provide a tearing edge.

12. A dispenser as in claim 1 wherein said slit is sinusoidal in configuration to provide a tearing edge.

13. A dispenser as in claim 1 having two pairs of spaced apart, generally planar side walls, one pair of which is longer than the other, one of said long side walls defining a front wall, and said slit is disposed at an angle to the juncture of said top to said front wall.

14. A dispenser as in claim 8 wherein said inner top member includes an outer margin and an inner recessed portion oriented spaced apart and parallel to each other and generally parallel to said base, said slit being disposed in said inner recessed portion, said inner recessed portion and said outer top member defining a space for retaining a portion of a towelette or its leader in a manner to reduce vapor loss from said towelette.

15. A dispenser as in claim 1 wherein said base portion is adapted to cooperatingly engage means for removably holding said dispenser on a surface.

16. A dispenser as in claim 1 wherein a portion of said body is adapted to cooperatingly engage means for removably holding said dispenser on a surface.

17. A pre-moistened towelette assembly as in claim 1 wherein said fluid includes water.

18. A pre-moistened towelette assembly as in claim 1 wherein said fluid includes a washing compound.

19. A pre-moistened towelette assembly as in claim 1 wherein said fluid includes a medicinal.

20. A pre-moistened towelette assembly as in claim 1 wherein said leader is disposed inside said pouch.

21. A pre-moistened towelette assembly as in claim 20 wherein at least one margin of said pouch is adapted to be opened by a shearing action of pulling a portion of said margin relative to said pouch.

22. A pre-moistened towelette assembly as in claim 1 wherein said absorbent roll is coreless.

23. A pre-moistened towelette assembly as in claim 22 wherein said web is withdrawn from the exterior of said coreless roll.

24. A pre-moistened towelette assembly as in claim 22 wherein said web is withdrawn from the center of said coreless roll.

25. A pre-moistened towelette assembly as in claim 1 wherein said perforations are oriented substantially perpendicular to the longitudinal axis of said roll.

26. A pre-moistened towelette assembly as in claim 1 wherein said perforations are oriented at an angle diagonal to the longitudinal axis of said roll.

27. A pre-moistened towelette assembly as in claim 1 wherein said assembly is color coded to identify the type of chemical-containing fluid impregnated in said roll.

28. A pre-moistened towelette assembly as in claim 1 wherein said pouch is plastic.

29. A pre-moistened towelette assembly as in claim 1 wherein said plastic is selected from a polyolefin, polyester, an acrylate, a polystyrene, a polyvinyl chloride, a polyvinylidene chloride, and mixtures, co-polymers, co-extrudates, or laminates of one or more of said plastics.

30. A pre-moistened towelette assembly as in claim 1 wherein said web comprises a plurality of layers.

31. A pre-moistened towelette assembly as in claim 30 wherein said plurality of layers are formed by at least one fold in said web, said fold being disposed parallel to the longitudinal axis of said web.

32. A pre-moistened towelette assembly as in claim 31 having a single fold forming two leaves which overlie each other.

33. A pre-moistened towelette assembly as in claim 31 having two folds forming three leaves which overlie each other.

* * * * *

UNITED STATES PATENT AND TRADEMARK OFFICE

CERTIFICATE OF CORRECTION

PATENT NO. : 3,986,479

DATED : October 19, 1976

INVENTOR(S) : Joseph P. Bonk

It is certified that error appears in the above-identified patent and that said Letters Patent are hereby corrected as shown below:

Column 3, line 54, after "14-14" add -- of -- .

Column 7, line 28, "i" should be -- in -- .

Column 7, line 52, "cooperatively" should be -- cooperatingly -- .

Column 9, line 24, "13-6" should be -- 13-16 -- .

Column 9, line 25, "incorporates" should be -- incorporate -- .

Column 11, line 14, "adpated" should be -- adapted -- .

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*